US007367518B2

(12) United States Patent
Tanigaki et al.

(10) Patent No.: US 7,367,518 B2
(45) Date of Patent: May 6, 2008

(54) DESCALING NOZZLE

(75) Inventors: Akihiko Tanigaki, Hikami-gun (JP); Takashi Nishiyama, Hikami-gun (JP); Kenta Karube, Kurashiki (JP); Kazunari Andachi, Kurashiki (JP)

(73) Assignees: Kyoritsu Gokin Co., Ltd., Hyogo (JP); JFE Steel Corporation, Tokyo (JP)

( * ) Notice: Subject to any disclaimer, the term of this patent is extended or adjusted under 35 U.S.C. 154(b) by 310 days.

(21) Appl. No.: 10/505,478

(22) PCT Filed: Dec. 17, 2003

(86) PCT No.: PCT/JP03/16137

§ 371 (c)(1),
(2), (4) Date: Aug. 24, 2004

(87) PCT Pub. No.: WO2004/058427

PCT Pub. Date: Jul. 15, 2004

(65) Prior Publication Data

US 2005/0156064 A1 Jul. 21, 2005

(30) Foreign Application Priority Data

Dec. 25, 2002 (JP) ..... 2002-375187

(51) Int. Cl.
*A62C 31/02* (2006.01)
*B05B 1/26* (2006.01)
*B05B 1/00* (2006.01)

(52) U.S. Cl. ..... 239/601; 239/600; 239/592; 239/597

(58) Field of Classification Search ..... 239/601, 239/590.3, 590.5, 552, 568, 590, 592, 593, 239/594, 597, 599, 600
See application file for complete search history.

(56) References Cited

U.S. PATENT DOCUMENTS 2,341,859 A * 2/1944 Edwards ..... 239/543
3,510,065 A * 5/1970 Gigantino et al. ..... 239/590
4,365,758 A * 12/1982 Schaming ..... 239/590
4,848,672 A 7/1989 Matsumoto et al.
5,158,235 A * 10/1992 Johnson ..... 239/570
5,931,392 A * 8/1999 Adams ..... 239/589
6,402,062 B1 * 6/2002 Bendig et al. ..... 239/599

FOREIGN PATENT DOCUMENTS

| | | |
|---|---|---|
| DE | 29 27 737 | 9/1981 |
| DE | 92 17 671 | 2/1993 |
| EP | 0 792 692 | 9/1997 |
| EP | 1 046 426 | 10/2000 |
| JP | 1-111464 | 4/1989 |
| JP | 6-73697 | 9/1994 |
| JP | 8-024937 | 1/1996 |
| JP | 9-094486 | 4/1997 |
| JP | 2000-263124 | 9/2000 |
| JP | 2000-334335 | 12/2000 |

* cited by examiner

*Primary Examiner*—Kevin Shaver
*Assistant Examiner*—James S. Hogan
(74) *Attorney, Agent, or Firm*—Wenderoth, Lind & Ponack, L.L.P.

(57) ABSTRACT

A nozzle orifice of a nozzle (1) includes a tapered segment (16) extending from an elliptical discharge orifice (15) and having a taper angle θ of 30 to 80°, and a large-diameter segment (18) continuing with the tapered segment. The ratio of the inner diameter of large-diameter segment (18) relative to the minor diameter of the discharge orifice (15) is not less than 3 and less than 7. Also, the discharge how from the nozzle spreads in a single direction (width direction) within a plane perpendicular to the central axis of the nozzle and the erosion thickness angle is 1.5 to 3° in the direction (thickness direction), perpendicular to the width direction. Such a descaling nozzle enables that scale is removed efficiently at low pressure and/or low flow rate while restraining the cooling of a steel plate.

13 Claims, 8 Drawing Sheets

DESCALING NOZZLE

BACKGROUND OF THE INVENTION

1. Technical Field

The present invention relates to a descaling nozzle for removing scale from a surface of a rolled steel manufactured by hot rolling and a cemented carbide nozzle tip which is useful for this nozzle.

2. Description of the Related Art

A hot rolled steel is manufactured by heating a steel slab to about 1100 to 1400° C. in a heating furnace under an oxidizing atmosphere and hot rolling the heated slab by a rolling mill. Due to the heating in the above-mentioned heating furnace, scale comprising iron oxide forms on the surface of the steel slab, and if hot rolling is performed without removing this scale, scale cracks are formed on the surface of the rolled steel and lower the product value. Descaling nozzles have been proposed for removing such scale by a high-pressure jet of water.

Japanese Patent Application Laid-Open No. 24937/1996 (JP-8-24937A) discloses a steel plate surface cleaning method in which the surface temperature of a steel plate is heated to not lower than 850° C. and liquid droplets, generated in the liquid drip flow region of a discharged liquid flow from a nozzle, collide with the surface of the steel plate for cleaning. This literature also discloses that a liquid discharged from a nozzle is collided with the surface of a steel plate containing Si in an amount of not less than 0.5 weight %.

Japanese Patent Application Laid-Open No. 334335/2000 (JP-2000-334335A) discloses a high-pressure jet nozzle comprising an elliptical opening which forms the entrance of an exit flow path, and a supply flow path which narrows towards the elliptical opening, in which only the side wall of the exit flow path in the direction of the major axis of the ellipse enlarges in the direction of flow, and the side wall in the direction of the minor axis of the ellipse extends substantially parallel to the axial line of the supply flow path.

However, according to these nozzles, water should be jetted with a high pressure and it is difficult to remove scale efficiently with a low pressure or a low flow rate.

Japanese Patent Application Laid-Open No. 263124/2000 (JP-2000-263124A) discloses a descaling nozzle, for removing scale by discharging water from a nozzle at a discharge pressure of not lower than 40 MPa and for colliding the water onto the surface of a steel plate with a distance between a discharge orifice and the steel plate of not longer than 150 mm, in which the discharge direction of the discharge flow spreads in the width direction within a plane perpendicular to the central axis of the nozzle, and the discharge flow has an erosion thickness angle in the range of 1.5 to 2.5° in the thickness direction perpendicular to the width direction. This literature also discloses a flat spray nozzle for descaling, wherein an enlarged passage is provided at the upstream side of the discharge orifice, and the inner diameter of the enlarged passage is 7 to 10 times that of the discharge orifice and the length of the enlarged passage is not less than 100 mm. Further, the document discloses a method of descaling a steel plate surface in the hot rolling process of a high-Si-containing steel, in which water is discharged from the nozzle at a discharge pressure of not less than 40 MPa with maintaining a distance from the discharge orifice to the steel plate of 75 to 150 mm.

However, with the above-described descaling nozzle and descaling method, it is required to discharge water at a high pressure and a high flow rate in order to make the erosion amount large. Furthermore, since the inner diameter of the enlarged passage is large with respect to the discharge orifice, the nozzle size becomes large.

Japanese Patent Publication No. 73697/1994 (JP-6-73697B) discloses a scale removal nozzle comprising a rectifying flow path in which a rectifier is disposed therein and is substantially equal in diameter across the entire length, a constricted flow path formed at the downstream side of the rectifying flow path and becomes gradually smaller in diameter towards the downstream side, and a jetting passage formed at the downstream side of the constricted flow path and extends to a jetting opening which is opened at the bottom of a groove formed at the front end face of the nozzle.

Japanese Patent Application Laid-Open No. 94486/1997 (JP-9-94486A) discloses a descaling nozzle comprising a flow path which becomes gradually smaller in diameter towards the downstream side, and a slit-like orifice communicating with the flow path and extending to a front end, the flow path and the orifice being formed in a main nozzle body made of a cemented carbide. This nozzle has a concave surface which is formed at the front end of the main nozzle body and has an inclined side wall that narrows towards the upstream side, and a jetting opening which is opened at the bottom of the concave surface and extends to the orifice. This literature discloses that the concave surface may have a circumferential wall extending in the axial direction from the upstream end of the inclined wall.

The nozzles described in these literatures are useful for improving the wear resistance of the orifice due to ultrahigh-pressure water. However, it is necessary to discharge water with a high pressure and a high flow rate in order to realize a high descaling efficiency.

DE No. 92U17671 Specification illustrates a nozzle comprising a discharge orifice formed at the front end of the nozzle, a first conical flow path spreading at an angle of about 50° towards the upstream side from the discharge orifice, a first cylindrical flow path extending in the upstream direction from the upstream end of the first conical flow path and having an inner diameter of about twice the inner diameter of the discharge orifice, a second conical flow path spreading at an angle of about 70 to 80° in the upstream direction from the upstream end of the first cylindrical flow path, a second cylindrical flow path extending in the upstream direction from the upstream end of the second conical flow path and having an inner diameter of about four times the inner diameter of the discharge orifice, and an inclined flow path spreading gradually and extending in the upstream direction from the upstream end of this cylindrical flow path (FIG. 1 in DE No. 92U17671 Specification).

However, even with this nozzle, water should be discharged at a high pressure and a high flow rate in order to realize a high descaling efficiency. Further, since two conical flow paths are formed, the nozzle has a complicated structure essentially. Furthermore, it is especially difficult to prepare a nozzle tip having two conical flow paths from cemented carbide.

Thus an object of this invention is to provide a descaling nozzle and a cemented carbide nozzle tip that realize efficient scale removal even at a low pressure and/or a low flow rate.

Another object of this invention is to provide a descaling nozzle and a cemented carbide nozzle tip that improve the descaling performance (or efficiency) with inhibiting the cooling of the steel plate.

It is still another object of this invention to provide a descaling nozzle and a cemented carbide nozzle tip that are compact and high in descaling performance (or efficiency).

It is a further object of this invention to provide a descaling nozzle and a cemented carbide nozzle tip useful for descaling of steel material in hot rolling.

DISCLOSURE OF THE INVENTION

The inventors of the present invention made intensive studies to achieve the above objects and finally found that by forming a nozzle orifice extending from a discharge orifice which is opened at a concave surface of a front end, as a specific conical tapered manner, the descaling efficiency can be improved remarkably even at a low pressure and/or a low flow rate. The present invention has been accomplished based on the above findings.

That is, the descaling nozzle of the present invention is a descaling nozzle for removing scale from a steel plate surface by discharging water from a nozzle, and this nozzle has a nozzle orifice comprising: a discharge orifice opening at a concave surface or concave area of a front end, a tapered segment (conical or spindle-shaped tapered segment, etc.) extending from the discharge orifice, and a large-diameter segment (cylindrical enlarged diameter part, etc.) continuing with the tapered segment. In this nozzle, the taper angle θ of the tapered segment is not particularly limited, and may be formed to be about 30 to 80° (for example, about 40 to 70°). Moreover, the ratio ($D_1/D_2$) of the inner diameter $D_1$ of the large-diameter segment relative to the minor diameter $D_2$ of the discharge orifice may be not less than 3, or not less than 3 and less than 7. In order to make the nozzle compact, the ratio ($D_1/D_2$) of the inner diameter $D_1$ of the large-diameter segment relative to the minor diameter $D_2$ of the discharge orifice may, for example, be about 3 to 6 (for example, about 4 to 6). The shape (or configuration) of the discharge orifice may be an elliptical shape. Furthermore, usually in the nozzle, the discharge flow from the nozzle spreads in a single direction (width direction) within a plane perpendicular to the central axis of the nozzle. Furthermore, the nozzle may have an erosion thickness angle of 1.5 to 3° in the direction (thickness direction) perpendicular to the width direction of the discharge flow.

More specifically, the flow path of the nozzle may comprise the discharge orifice opening in an elliptical configuration (or shape) at the concave surface or concave area at the front end, the tapered flow path extending towards the upstream side from the discharge orifice with spreading at a taper angle θ of 40 to 60°, and the cylindrical flow path extending from the upstream end of the tapered flow path with the inner diameter being substantially the same. Further, in the elliptical discharge orifice, the ratio of the major diameter relative to the minor diameter may be about 1.2 to 2.5, and the ratio ($D_1/D_2$) of the inner diameter $D_1$ of the conical flow path relative to the minor diameter $D_2$ of the discharge orifice may be about 4 to 6.

In the nozzle, a nozzle tip (a nozzle tip formed out of cemented carbide) is usually attached or fitted to the front end of the nozzle. This invention also includes a nozzle tip attachable to the front end of the above-described nozzle. This nozzle tip is formed out of cemented carbide and the ratio ($D_1/D_2$) of the inner diameter $D_1$ of the upstream end relative to the minor diameter $D_2$ of the discharge orifice is not less than 3. The nozzle tip may comprise a discharge orifice opening at a concave surface or concave area formed at a front end, and a conical flow path spreading at a predetermined taper angle θ towards the upstream side from the discharge orifice. Moreover, the concave surface or concave area may comprise an inclined side wall which inclines inwardly in the radial direction towards the upstream side from the front end.

The above-described nozzle is useful as a descaling nozzle for removing scale from a steel plate by discharging water from a nozzle at a low pressure (for example, a pressure of 5 to 30 MPa) and/or a low discharge flow rate (for example, a discharge flow rate of 40 to 200 l/minute). It is also useful as a descaling nozzle for removing scale from the surface of a steel plate (for example, a low-Si-containing steel plate or ordinary steel plate) by discharging water from a nozzle with the distance between the discharge orifice and the steel plate being not longer than 600 mm (for example, not longer than 200 mm).

According to the nozzle, since the nozzle orifice comprises a discharge orifice opening at a concave surface at a front end, a tapered segment (or site) extending to the discharge orifice, and a large-diameter segment (or cylindrical hollow site), the collisional force can be increased even at low discharge pressure or low discharge flow rate and the descaling efficiency can thus be improved. Since the erosion efficiency can also be improved at a low flow rate, the temperature drop (or lowering) of the steel plate can also be inhibited greatly.

In the description, the phrase "large-diameter segment" refers to a flow path that is continuous in the upstream direction from the tapered segment continuing with the discharge orifice and means a flow path extending with the inner diameter $D_1$ being substantially the same from the upstream end of the tapered segment. The word "large-diameter segment" may thus be used synonymously with the word "cylindrical flowpath". "The inner diameter being substantially the same" from the upstream end of the tapered segment means a mean inner diameter of a flow path extending at an inclination angle of 0 to 3° (particularly 0 to 2°). The inclination angle over 3° is defined as a taper angle. The expression "A flow path extending with the inner diameter being substantially the same" refers to a flow path having the ratio ($L/D_1$) of the flow path length L relative to the inner diameter $D_1$ of the flow path being not less than 1. Further, even if part of the flow path is of substantially the same inner diameter, if the ratio ($L/D_1$) of the flow path length L relative to the inner diameter $D_1$ of the flow path is less than 1 ($L/D_1<1$), the part shall be deemed to be part of the tapered segment. Thus, in a nozzle or nozzle tip having a cylindrical flow path extending with the inner diameter being substantially the same in the upstream direction from a discharge orifice, and a conical flow path extending in the tapered form in the upstream direction from the cylindrical flow path, or in a nozzle or nozzle tip having a conical flow path extending in the tapered form in the upstream direction from a discharge orifice, and a cylindrical flow path extending with the inner diameter being substantially the same in the upstream direction from the conical flow path, if the ratio ($L/D_1$) of the flow path length L relative to the inner diameter $D_1$ of the cylindrical flow path is less than 1 ($L/D_1<1$), this cylindrical flow path forms a tapered flow path. Furthermore, the expression "the ratio of the inner diameter of the large-diameter segment relative to the minor diameter of the discharge orifice" means "the ratio of the inner diameter of the downstream end of the large-diameter segment (or the upstream end of the tapered segment) relative to the minor diameter of the discharge orifice".

DETAILED DESCRIPTION OF THE INVENTION

This invention shall now be described in detail with reference to the attached drawings where necessary.

Figure 1:
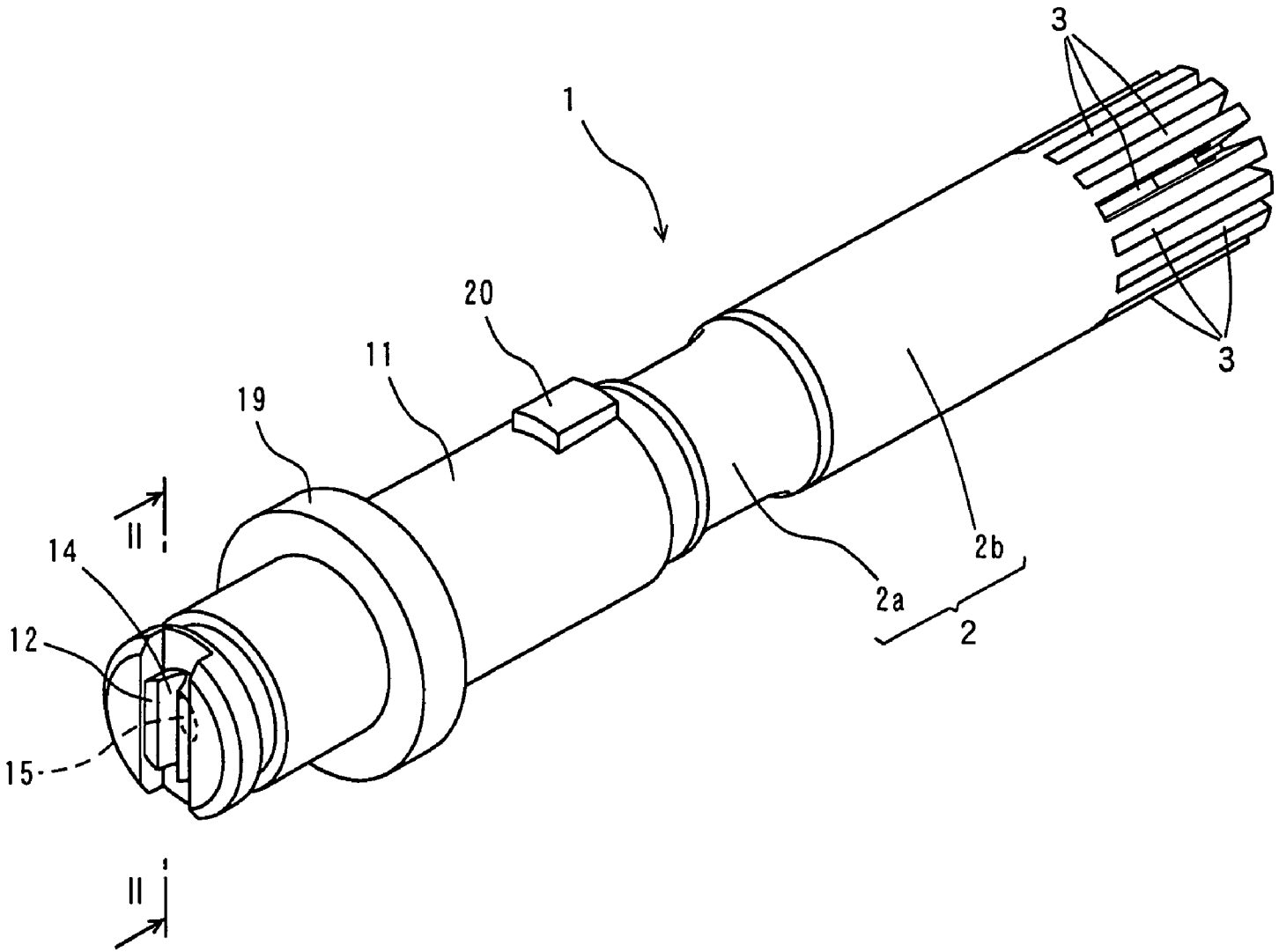
FIG. 1 is a schematic perspective view showing an embodiment of the descaling nozzle of the present invention.
Figure 2:
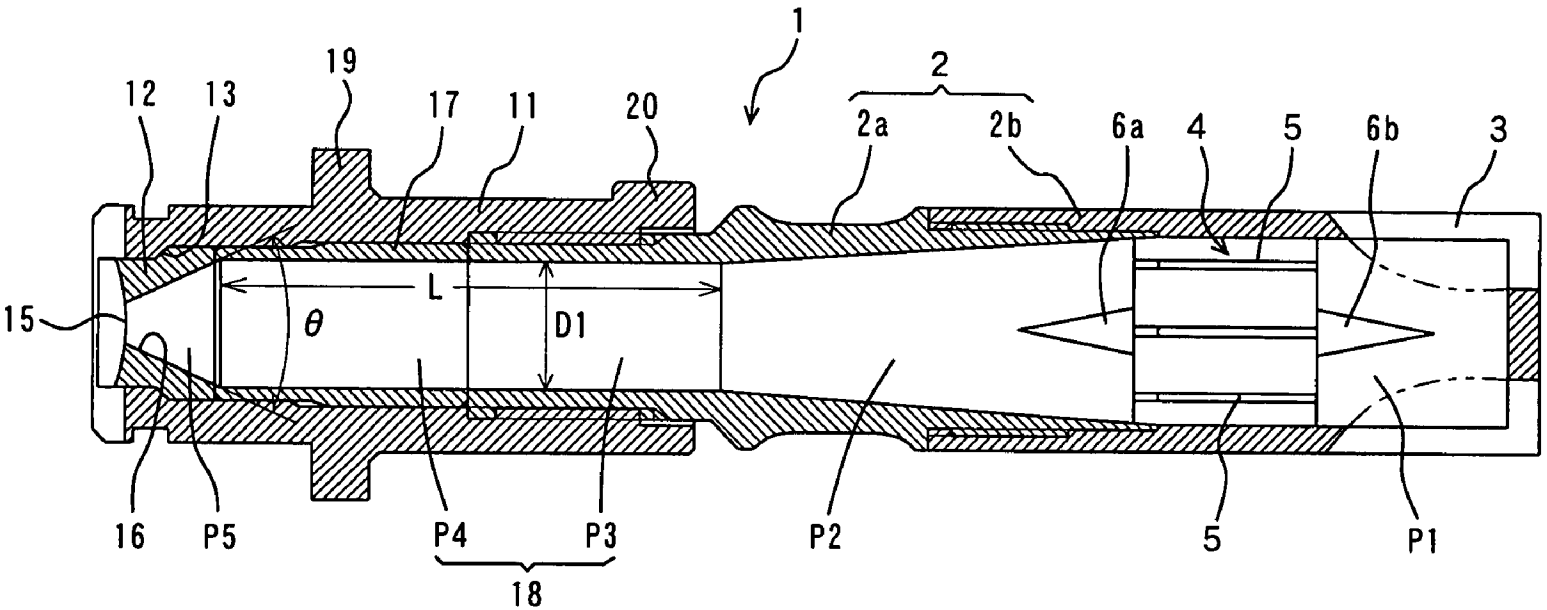
FIG. 2 is a schematic sectional view taken along line II-II of FIG. 1.
Figure 3:
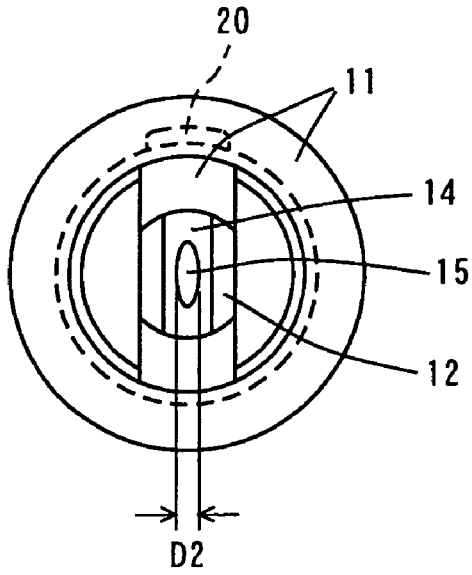
FIG. 3 is a schematic front view of the nozzle front end of FIG. 1.

FIG. 1 is a schematic perspective view showing an embodiment of the descaling nozzle of the present invention, FIG. 2 shows a schematic sectional view along line II-II of FIG. 1, and FIG. 3 illustrates a schematic front view of the nozzle front end shown in FIG. 1.

As shown in FIGS. 1 through 3, the descaling nozzle 1 comprises a cylindrical casing 2 into which water can flow from the upstream side and which has a cylindrical flow path (hollow cylindrical passage or nozzle orifice), a cylindrical nozzle case 11 in which the casing can be fitted, and a cemented carbide nozzle tip 12 which is fitted onto the front end of the nozzle case and is for discharging a discharge flow from its front end via a flow path (or nozzle orifice). The nozzle orifice or the flow path is formed in the axial direction of the central axes of these members. In the present embodiment, the cylindrical casing 2 comprises a first casing 2*a* which can be screwed into the nozzle case 11, and a second casing 2*b* which can be fitted onto this casing 2*a*, and the first and second casings 2*a* and 2*b* are united with each other by screwing, or the like.

At the circumferential face and end face (flat face) of the upstream end of the second casing 2*b*, a plurality of slits (or inflow entrances) 3 are formed at predetermined intervals in the circumferential direction to form a filter, and the slits extend in the axial direction and are for allowing the inflow of water while inhibiting the inflow of foreign matter. Further, in order to guide water flowing from the filter to the nozzle orifice, a rectifying unit (or a rectifier or a stabilizer) 4 is disposed or installed in the flow path inside the second casing 2*b*, and this rectifying unit 4 is provided with a plurality of rectifying plates (rectifying blades) 5 extending in the radial direction from a core body, and sharp conical sections (conical parts that are narrowed to a point at the upstream side and the downstream side 6, respectively) 6*a* and 6*b*, the conical sections being formed coaxially at the upstream side and downstream side of the core body and having their sharp end portions directed in to the upstream and downstream directions, respectively. The second casing 2*b*, which forms a filter and is equipped with a rectifying units may be called a filter unit or a rectifying casing. The rectifying plates 5 of the rectifying unit 4 contact the inner wall of the casing and the rectifying unit 4 is restricted in movement towards the downstream side by a fixing means (engagement, fitting, welding, adhering, etc.).

The flow path of the cylindrical casing 2 comprises a cylindrical flow path P1 extending from the upstream end (inflow entrance) of the second casing 2*b* to the downstream end of the rectifying unit 4 and being of substantially the same inner diameter, an inclined flow path (annular inclined flow path) P2 extending in the downstream direction from the downstream end of the above-described rectifying unit 4 to a middle part of the first casing 2*a* and narrowing in a tapered form at a gradual or progressive incline, and a cylindrical flow path P3 extending in the downstream direction from the downstream end of the inclined flow path with the inner diameter being substantially the same. in the present embodiment, the taper angle of the inclined wall (tapered segment) forming the inclined flow path (annular inclined flow path) P2 is formed to be, for example, about 5 to 10°.

Inside the nozzle case 11, a cemented carbide nozzle tip 12 and a bushing (or annular side wall) 17 having a flow path of substantially the same inner diameter as that of the downstream end of the first casing 2*a* are successively fitted from the front end towards the upstream direction, and the nozzle tip 12 is prevented from falling through in the direction of the front end by an engagement step 13. At the front end face of the nozzle tip 12, a curved groove 14 of a U-letter configuration in cross section is formed in the radial direction and a discharge orifice 15 having an elliptical shape is opened at the curved concave surface of the curved groove 14. The bottom surface of the curved groove 14, which has a U-letter configuration in cross section, may be a curved bottom surface with the discharge orifice 15 at the lowermost area and being raised at both ends towards the direction to which the bottom surface extends (or the radial direction).

The nozzle orifice extending in the axial direction of the nozzle 1 comprises the discharge orifice (or spray opening) 15 opening in an elliptical shape (or configuration) at the above-mentioned curved concave surface 14, a conical flow path P5 formed in the nozzle tip 12 and formed by a tapered segment (or conical inclined wall) 16 that extends while rectilinearly enlarging in diameter towards the upstream direction along the axial line from the discharge orifice 15, and a cylindrical flow path P4 formed by the bushing 17 and being continuous in the upstream direction with the inner diameter being substantially the same along the axial direction from the upstream end of the tapered segment 16. That is, the flow path (nozzle orifice) of the nozzle 1 comprises the discharge orifice 15 opening in an elliptical shape at the curved concave surface 14 at the front end, the tapered flow path (or conical flow path) P5 extending towards the upstream side from the discharge orifice while spreading or expanding at a predetermined taper angle θ due to the tapered side wall (conical side wall) 16, and large-diameter cylindrical flow paths (flow paths extending from the upstream end of the tapered flow path P5 to the upstream end of the rectifying unit 4) P4 to P1, and the large-diameter cylindrical flow paths extend from the upstream end of the tapered flow path with the inner diameter being substantially the same due to the annular side wall of the bushing 17. The flow paths that extend from the upstream end of the tapered segment 16 with the inner diameter being substantially the same (in the present embodiment, the cylindrical flow paths P3 and P4 extending from the upstream end of the large-diameter segment to the downstream end of the gradually inclined flow path P2) may be arranged as a large-diameter segment 18.

Furthermore, the discharge orifice 15 of elliptical shape is formed to have a major diameter relative to minor diameter ratio of about 1.5 to 1.8, and in regard to the relationship of the discharge orifice 15 of elliptical shape and the large-diameter segment 18, the ratio ($D_1/D_2$) of the inner diameter $D_1$ of large-diameter segment 18 (the cylindrical flow path P3 and P4, or the downstream end of the inclined flow path P2 extending towards the downstream direction from the rectifying unit) relative to the minor diameter $D_2$ of the discharge orifice 15 is set to about 4.5 to 6.9 in order to make the nozzle compact. Furthermore in order to increase the collisional force even at a low pressure and/or a low flow rate, the angle (taper angle) θ of the tapered segment 16 is formed to about 45 to 55°.

A collar unit (or flange) 19 or other attachment part may be formed at a suitable location or position of the nozzle case 11 or cylindrical casing 2 (the nozzle case in the present embodiment) for attachment of the nozzle 1 to a duct (not shown) using an adapter (not shown). Further, a protrusion 20 for positioning relative to a duct may be formed on the nozzle case 11 in order to increase the precision of positioning and make a flat or strip-shaped discharge flow be jetted in a predetermined direction.

When such a nozzle 1 is used, since the tapered segment 16 inclines rectilinearly from the large-diameter segment 18 of the nozzle orifice to the discharge orifice 15, a sharp collisional force distribution can be realized and scale can be removed efficiently with a low pressure and a low flow rate, even with a compact arrangement. Further, since descaling can be conducted with a low pressure and a low flow rate, the descaling efficiency can be improved while inhibiting the cooling of a steel plate. Furthermore, by bringing the nozzle 1 close to a steel plate, the collisional force can be enhanced further to improve the descaling performance. The above-described nozzle 1 is thus useful as a descaling nozzle (or flat descaling nozzle) for discharging water to remove scale from the surface of a steel plate produced by hot rolling, or the like.

In the nozzle of the present invention, as long as the nozzle has a nozzle orifice extending from a large-diameter segment to a discharge orifice via a predetermined tapered segment and a flat spray nozzle can be arranged, the shape of the nozzle orifice including the discharge orifice, is not restricted in particular and various nozzle orifices may be used. For example, the concave surface at the front end of the nozzle is not limited to the above-described groove having the U-letter configuration in cross section (curved cross-section surface) and may be a curved concave surface (a curved surface wherein the opening or front side is broad or wide and the upstream or bottom side is narrowed, for example, a curved concave surface such as a spherical concave surface, an elliptical concave surface, a bowl-like concave surface, or a bell-like concave surface). Furthermore, the concave surface at the nozzle front end may be formed by a concave section (or site) having a side wall which inclines in a curving or in a rectilinear manner.

Figure 4:
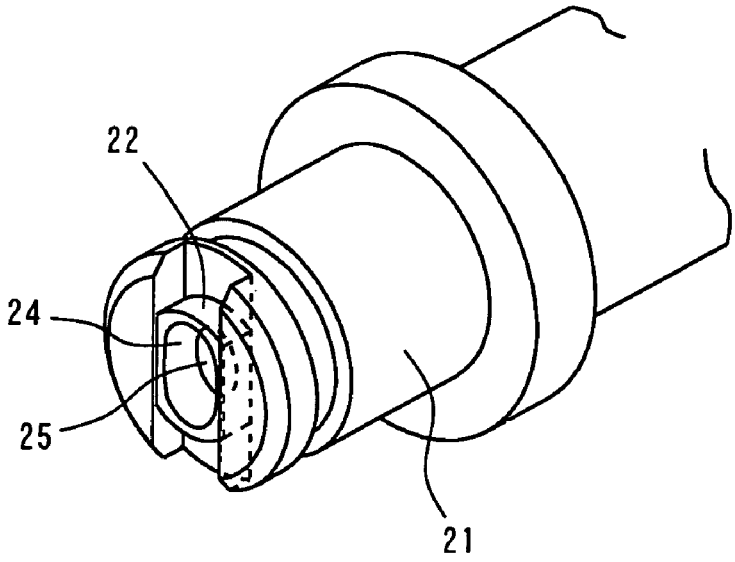
FIG. 4 is a partial schematic perspective view showing another embodiment of this invention's nozzle front end.
Figure 5:
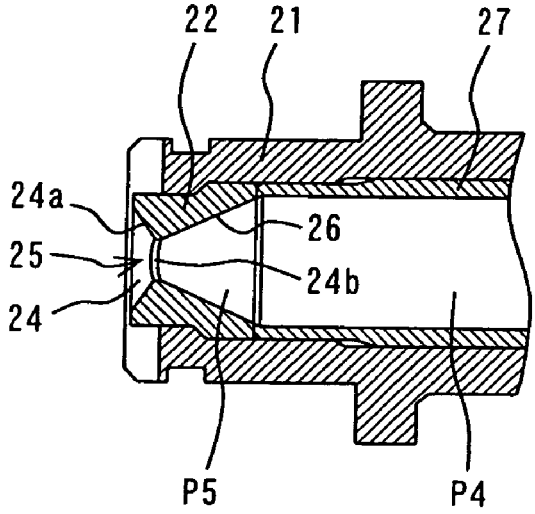
FIG. 5 is a schematic sectional view showing the front end of the nozzle of FIG. 4.

FIG. 4 is partial schematic perspective view showing another embodiment of the nozzle front end of the present invention and FIG. 5 shows a schematic sectional view of the nozzle front end of FIG. 4. In this embodiment, an elliptical concave area 24 (or annular concave area) is formed at the front end of a cement carbide nozzle tip 22, which is fitted or affixed onto a nozzle case 21, and this concave area 24 comprises an inclined side wall 24*a* which inclines (or narrows) inwardly, in rectilinear or curving manner, in the radial direction towards the upstream side from the nozzle front end, and a circumferential wall 24*b* extending in the axial direction from the upstream end of the inclined side wall. At the central site or part of such a concave area 24 is opened an elliptical discharge orifice 25 having the same axial line as the major axis of the above-described elliptical concave area 24. As in the above-described embodiment, in the upstream direction from this discharge orifice (or the upstream end of the above-mentioned circumferential wall) 25 are formed, a tapered flow path (or conical flow path) P5 spreading or extending at a predetermined taper angle θ due to a tapered annular side wall (or tapered side wall) 26, and a flow path (large-diameter flow path or large-diameter segment) P4 (or P4 to P1) extending with substantially the same inner diameter due to a bushing or an annular side wall 27.

With such a nozzle, since water can be sprayed from the discharge orifice via the large-diameter segment and tapered segment, the descaling efficiency can be improved even at a low pressure and/or a low flow rate. Furthermore, since a predetermined thickness can be secured along the entire circumference of the discharge orifice by means of the circumferential wall and an angle of the tapered segment (or tapered side wall) against the inclined side wall can be increased to make the wall thicken, the wear resistance of the nozzle orifice including the discharge orifice can be improved. Furthermore, since the inclined side wall is formed across the entire circumference of the discharge orifice and the discharge orifice is positioned at a deep section or area, even if the discharge flow from the nozzle splashes back from a steel plate, etc., the anxiety of collision of the bounced water against the discharge orifice and its peripheral area can be lessened. The durability of the nozzle can thus be improved.

Since the entire circumference of the discharge orifice can be thickened for improving the wear resistance of the nozzle even without forming the circumferential wall of the concave surface or concave area, the above-described circumferential wall of the concave surface or concave area is not required in particular, and the discharge orifice may be opened at the above-described inclined side wall. Further, the wall face of the circumferential wall does not need to be a flat surface extending in the axial direction and may be a rounded or curved surface. The above-described inclined side wall may be able to contact with the discharged water, and it is preferred, in terms of improving the wear resistance of the discharge section and maintaining or retaining the pattern of jetting from the discharge orifice, that the discharged water does not contact the inclined side wall. The inclination of the inclined side wall may thus be adjusted to an angle that is non-contacting with the discharged water, that is, for example, to about 45 to 80° and especially about 50 to 70°.

The nozzle orifice may usually comprise a discharge orifice opening at a concave surface or concave area at a front end, a tapered segment extending from the discharge orifice, and a large-diameter segment being continuous with the tapered segment, and usually an inclined wall is formed between the discharge orifice and the end face of the tip.

The shape of the discharge orifice is not limited to the above-described specific elliptical shape and discharge orifices of various shapes, such as a flat shape, may be employed, and an elliptical shape is usually provided. For example with respect to an elliptical discharge orifice, the ratio of the major diameter relative to the minor diameter is such that, for example, the major diameter/the minor diameter is about 1.2 to 3, preferably about 1.2 to 2.5, and more preferably about 1.4 to 2.

Figure 6:
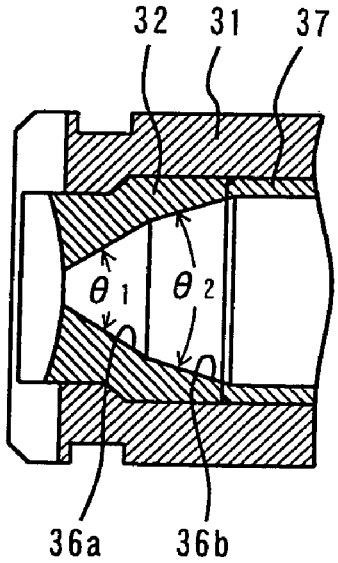
FIG. 6 is a schematic sectional view showing another embodiment of the tapered segment.

The tapered segment may be inclined rectilinearly (or linearly) with a predetermined angle, may be inclined with a plurality of different angles, or may be inclined curvingly. FIG. 6 is a schematic sectional view showing another embodiment of the tapered segment.

With this embodiment, a tapered segment (tapered side wall) 36 extending in the upstream direction from a discharge orifice is formed on a nozzle tip 32, which is fitted or attached into a nozzle case 31, and the tapered segment comprises two tapered segments, for example, a first tapered segment (conical side wall) 36*a* with a large taper angle (inclination angle) θ1, and a second tapered segment (truncated conical side wall) 36*b* continuing from the upstream end of the first tapered segment and having a taper angle (inclination angle) θ2 which is smaller than that of first tapered segment 36*a*. The first tapered segment 36*a* may be formed to have a taper angle η1 of about 50 to 90° (for example, about 50 to 80°) and the second tapered segment 36*b* may be formed to have a taper angle θ2 of about 20 to 55° (for example, about 30 to 50°). Further, a cylindrical flow path formed by a bushing or annular wall 37 continues from the upstream end of the second tapered segment 36*b*.

The above-mentioned tapered segment may be a multistep (or multistage) tapered segment comprising a plurality of tapered segments each having a different angle (for example, not less than three tapered segments). The plurality of tapered segments may be formed so that their taper angles increase successively or decrease successively towards the upstream direction. Though the plurality of tapered segments may be formed so as to be separated in the upstream direction from the tapered segment of the front end, the plurality of tapered segments are usually formed so as to be adjacent or continuous with the tapered segment at the front end. Furthermore, as long as a tapered segment that increases continuously in inner diameter towards the upstream side of the axial direction from the discharge orifice is formed, a tapered surface may be formed by a spindle-shaped curved surface (curved tapered surface).

The angle (taper angle) θ of the above-mentioned tapered segment is not particularly limited and may be selected from the range of about 20 to 80°, and may usually be selected, for example, from a range of about 30 to 80° preferably about 35 to 75° (for example, about 35 to 60°), more preferably about 40 to 70°, and especially about 40 to 60°. In the case where the tapered segment comprises a plurality of tapered sections or a curved section(s), the above-mentioned taper angle θ refers to the angle formed by lines joining the smallest orifice section (discharge orifice) positioned at the discharge side (downstream side) and the starting end of the large-diameter segment positioned at the upstream side.

Incidentally, the ratio ($D_1/D_2$) of the inner diameter $D_1$ of the large-diameter segment relative to the minor diameter $D_2$ of the discharge orifice is not restricted in particular and may be about 2 to 10. In order to make the nozzle compact, the ratio ($D_1/D_2$) should be not less than 3 (especially, not less than 3 and less than 7), that is for example, about 3 to 6.9 (for example, about 3 to 6), preferably about 3.5 to 6.9 (for example, about 3.5 to 6), more preferably about 4 to 6.5 (for example, about 4 to 6), and may be 4.5 to 6 (for example, about 4.5 to 5.5). Incidentally, the inner diameter $D_1$ of the large-diameter segment may be about 8 to 20 mm (e.g., about 8 to 15 mm, preferably about 9 to 15 mm).

Though the large-diameter segment is usually formed to be substantially the same in inner diameter in many cases, as long as the descaling efficiency is not deteriorated, an inclination by which the inner diameter increases slightly towards the upstream direction at an angle of 0 to 3° may be provided as in the above-described inclined segment. The inclined flow path or passage (annular inclined flow path) P2 of the cylindrical casing mentioned above may be formed to have a taper angle of more than 3° to not less than 25° (preferably about 5 to 15°). The total length of the large-diameter segment (cylindrical large-diameter segment or large-diameter flow path site) is not restricted in particular to a specific one and, for example, may be about 30 to 300 mm (for example, about 50 to 200 mm) and preferably about 50 to 150 mm (for example, about 75 to 150 mm). The length of the large-diameter segment that extends with the inner diameter being substantially the same from the upstream end of the tapered segment (for example in the embodiment shown in FIG. 2, the length of the flow path extending to a middle site of the first casing) may, for example, be about 25 to 200 mm (for example, about 30 to 150 mm) and preferably about 35 to 150 mm (for example, about 40 to 125 mm).

It is sufficient that the nozzle of the present invention comprises a tapered segment extending in the upstream direction from the discharge orifice, and a large-diameter segment extending with the inner diameter being substantially the same from the tapered segment, and the above-described cylindrical casing is not required necessarily. Furthermore, the cylindrical casing does not have to be arranged by a first casing and a second casing and may be arranged with a single casing instead.

Furthermore, a rectifying unit is not required essentially at the upstream side of the nozzle, and a rectifying means, such as the above-described stabilizer (or rectifying unit) is usually disposed. Moreover, the stabilizer may be disposed at the upstream side of the large-diameter segment (or large-diameter flow path). Besides, as described above, the stabilizer may be disposed inside the casing at the upstream side of an inclined segment (or inclined flow path) which is formed at the upstream side of the large-diameter segment or cylindrical segment having substantially the same inner diameter and gradually and successively increases in inner diameter. Moreover, the stabilizer may be disposed or the stabilizer may be disposed by fixing or attaching to a predetermined position at the upstream side of the large-diameter segment having a substantially the same diameter. The structure of the stabilizer is not restricted in particular to a specific configuration and may be composed of a plurality of radially extending blades (rectifying plates or vanes) or a lattice-like or honeycomb-like flow path or, as described above, a plurality of blades extending radially at predetermined intervals in the circumferential direction from an axial member or core body that extends coaxial to the nozzle. Furthermore, conical sections are not essentially required at the upstream side and/or downstream side of the stabilizer, and rectifying guide members for guiding water (for example, the above-described conical sections or conical or nose-like guide members) are mounted or disposed in practical cases. Further, the number of rectifying plates is not restricted in particular and may, for example, be about 4 to 16.

Figure 7:
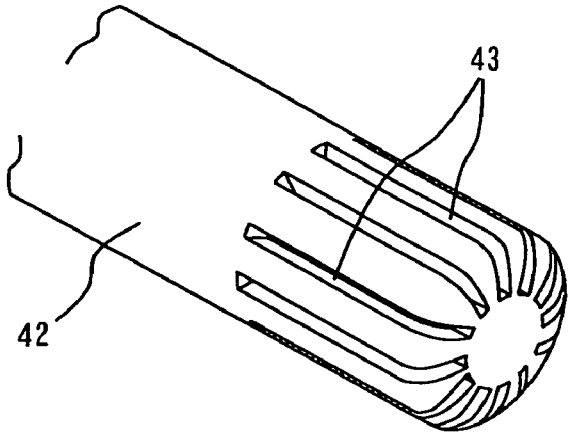
FIG. 7 is a schematic view showing another embodiment of the upstream end of the casing.

The upstream end of the cylindrical casing is not restricted to a flat end face as described above and may be formed as a curving end face or bulging end face. FIG. 7 is a schematic view showing another embodiment of the upstream end of the cylindrical casing.

In this embodiment, the end at the upstream side of a cylindrical casing 42 is formed as a curved end of nose-like or head-like form, and on the circumferential face and curved face of the end of the cylindrical casing 42, a plurality of slits 43 extending in the axial direction are formed at predetermined intervals in the circumferential direction. Inflow of water can be conducted smoothly to jet or spout a discharge flow from the discharge orifice uniformly with a high collisional force distribution, even with the slits of such a casing as well.

The inflow entrances constituting the above-described filter are not limited to axially extending slits and may be formed as slits extending in the circumferential direction, as slits extending in random directions, or as a plurality of orifices or holes (or openings). Further, the inflow entrances are not restricted to being provided at both the circumferential face and end face but may be formed on the circumferential face of the cylindrical casing or on the upstream end face. Furthermore, instead of forming the inflow entrances constituting the filter on the cylindrical casing, a rectifying unit may be disposed inside an upstream end of the cylindrical casing with the opening of the upstream end of the casing.

As is clear from the above, this description also discloses a nozzle tip, which is for forming a nozzle orifice continuing with a cylindrical large-diameter segment (large-diameter flow path) having almost the same inner diameter. The nozzle tip comprises a discharge orifice opening at a concave surface or concave area of a front end, and a tapered segment (or conical wall segment) formed to have a predetermined taper angle θ towards the upstream direction from the discharge orifice. Such a nozzle tip may be (1) a nozzle tip having a conical flow path formed by a tapered segment extending with a taper angle θ of 30 to 80° in the upstream direction of the discharge orifice to the upstream end, or (2) a nozzle tip having a flow path extending in the upstream direction from the discharge orifice with the inner diameter being substantially the same and having the ratio ($L/D_1$) of the length L relative to the inner diameter $D_1$ being less than 1 ($L/D_1<1$), and a conical flow path formed by a tapered segment extending with a taper angle θ of 30 to 80°0 in the upstream direction from the flow path. The nozzle tip may also have (3) a conical flow path formed by a tapered segment extending with a taper angle θ of 30 to 80° in the upstream direction from the discharge orifice, and a flow path extending in the upstream direction from the conical flow path with the inner diameter being substantially the same. In the nozzle tip (3), the flow path extending towards the upstream direction from the conical flow path may be such that the ratio ($L/D_1$) of the flow path length L relative to the inner diameter $D_1$ is less than 1 ($L/D_1<1$) or is not less than 1.

The nozzle tip may comprise a concave surface or concave area formed at a front end, a discharge orifice formed at a central area of the concave surface or concave area, and a conical flow path extending with a predetermined taper angle θ in the upstream direction from the discharge orifice. Further, the concave area formed at the end of the nozzle tip may comprise an inclined side wall which inclines inwardly in the radial direction towards the upstream direction from the nozzle front end.

This description also discloses a nozzle case having the above-described nozzle tip fitted or attached (or installed) to a front end, particularly a nozzle case comprising the above-described nozzle tip fitted (or attached or installed) to a front end, and a bushing disposed at the upstream end of the tapered segment of the nozzle tip and forming a flow path of substantially the same inner diameter as the above-described large-diameter segment from the upstream end of the tapered segment.

The above-described nozzle is also useful for removing scale from steel plates (for example, high-Si content steel plates with an Si content of not less than 0.5 weight %, especially an Si content of not less than 1 weight %) at a high pressure and/or a high flow rate. In such a method, water may be discharged or jetted at a pressure exceeding 30 MPa (for example, about 35 to 80 MPa, preferably about 37 to 60 MPa, and more preferably about 40 to 50 MPa). Further, water may be jetted from the discharge orifice at a large discharge flow rate, for example, of not less than 80 l/minute (for example, about 80 to 300 l/minute, preferably about 80 to 250 l/minute, and more preferably about 80 to 150 l/minute).

The nozzle of the present invention can remarkably improve the descaling efficiency even at a low pressure and/or a low flow rate. Thus, with a preferred descaling method, scale can be removed from a steel plate by discharging water from the nozzle at a low pressure, for example, a discharge pressure or jetting pressure of about 5 to 30 MPa (preferably about 8 to 25 MPa, more preferably about 10 to 20 MPa, and especially about 12 to 18 MPa). Furthermore, even if the flow rate of water is low, scale can be removed from a steel plate by discharging water from the nozzle. The cooling of a steel plate in a descaling process can thus be suppressed or inhibited and hot rolling can be carried out smoothly. The discharge flow rate or jetting flow rate of water may for example be selected from a range of about 40 to 200 l/minute and may usually be about 45 to 150 l/minute and preferably about 50 to 100 l/minute. According to the nozzle and method of the present invention, a high descaling efficiency can be realized even at a lower discharge flow rate of, for example, about 40 to 100 l/minute (for example, about 50 to 80 l/minute).

According to the method of the present invention, the discharge distance (spray distance) relative to a base material (steel plate) to be treated may for example be selected as appropriate from a range of not more than 600 mm (for example, about 50 to 500 mm) as long as the descaling efficiency is not adversely effected. For efficient descaling, the nozzle is used upon being set close to a steel plate. The discharge distance may be about not more than 200 mm (preferably about 50 to 200 mm, more preferably about 50 to 180 mm, and especially about 75 to 170 mm). The discharge distance is usually about 50 to 150 mm (for example, about 75 to 150 mm).

The discharge flow from the nozzle usually spreads in a single direction (plane direction or width direction) within a plane perpendicular to the central axis of the nozzle. Such a nozzle (flat spray nozzle) usually has a predetermined erosion thickness angle $\phi$ in the direction (thickness direction) perpendicular to the width direction and water is discharged (jetted) or sprayed at the predetermined erosion thickness angle $\phi$. The erosion thickness angle $\phi$ is not particularly limited to a specific angle as long as the descaling efficiency is not lowered and may for example be about 1.5 to 3° (preferably about 2 to 2.5°). The erosion thickness angle $\phi$ can be computed from the following equation:

$$\phi=2\tan^{-1}[(t-d)/2H]$$

wherein t (mm) indicates the erosion thickness, d (mm) indicates the minor diameter of the nozzle discharge orifice, and H (mm) indicates the spray distance or jetting distance.

According to such a nozzle, a sharp and yet uniform collisional force distribution can be realized. That is, in accordance with the nozzle and method of the present invention, the collisional force distribution of the discharge flow exhibits not only a sharp rise at both sides in the width direction but also exhibits a substantially uniform collisional force over its entirety in the width direction. Moreover, by use of the nozzle and method of the present invention, a uniform and high collisional force can be obtained over a wide range in the width direction of the discharge flow in the collisional force distribution. In regard to the collisional force distribution, the nozzle of the present invention differs significantly from prior-art nozzles that exhibit a hill-like collisional force distribution in which the collisional force at the central area in the width direction is strong and the collisional force decreases towards the side areas.

Thus with the nozzle and method of the present invention, a large aluminum erosion amount can be realized even at a low pressure and/or a low flow rate. For example, for the aluminum of JIS (Japanese Industrial Standards)-5050, wherein water is jetted at the conditions of a pressure of 15 MPa and a discharge flow rate of 66 l/minute, the aluminum erosion amount is about 0.01 to 0.015 g for jetting or spray distance from the nozzle (distance between the discharge orifice and the steel plate) of 150 mm, about 0.02 to 0.025 g for a jetting distance of 130 mm, and about 0.028 to 0.033 g for a jetting distance of 100 mm.

According to the invention, since a nozzle orifice is provided with a tapered segment and a large-diameter segment extending from a discharge orifice which opens at a concave surface, scale can be removed efficiently even at a low pressure and/or a low flow rate. Further, since descaling can be conducted efficiently at a low discharge flow rate, the descaling efficiency can be improved with suppressing the cooling of the steel plate. Furthermore, the descaling performance can be improved even with a compact size. This invention is thus useful for the descaling of steel plates of low-Si content in hot rolling processes.

The present invention can be used for the descaling of various steel plate surfaces (descaling of steel plate surfaces in hot rolling processes) and the type of steel plate is not limited particularly to a specific plate. For example, the steel plate may be a high-Si steel plate with a high Si content, and this invention can also be used effectively for the descaling of low-Si steel of low Si content (for example, ordinary steel with an Si content of not more than 0.5 weight % (about 0.2 to 0.5 weight %), etc.).

EXAMPLES

Though this invention shall now be described based on examples, this invention is not limited by these examples.

Examples 1 to 3

For spraying, the spray nozzle shown in FIG. 2 was used. This nozzle had a discharge orifice (having an elliptical shape with a major diameter of 3.78 mm, a minor diameter of 2.31 mm and the ratio of major diameter/minor diameter=1.6) in the nozzle tip; a tapered segment with a taper angle $\theta$=50°, a cylindrical flow path (large-diameter segment) with an inner diameter of $\phi$11 mm and a length of 43.4 mm that extended to a nozzle case and a middle part of a first casing; an inclined segment (inclined flow path) (length: 36.1 mm) extending with a taper angle of 7.5° from the upstream end of the cylindrical flow path (large diameter segment); a cylindrical flow path with an inner diameter of $\phi$16 mm extending from the upstream end of the inclined flow path and having a stabilizer (length in axial direction of the blades: 16 mm; eight blades extending radially from the axis part) fitted therein; and a plurality of slits formed at an upstream end of the second casing. The ratio ($D_1/D_2$) of the inner diameter $D_1$ of the cylindrical flow path (large-diameter part) which extended to a middle part of the first casing relative to the minor diameter $D_2$ of the discharge orifice was 4.8. The above-mentioned stabilizer was equipped at its upstream side and downstream side with conical members whose front ends were directed towards the upstream side and the downstream side, respectively.

Upon setting the jetting pressure (water pressure) of the spray to 15 MPa and the discharge flow rate to 66 l/minute, the aluminum (Al) erosion amount (the converted amount in 30 seconds) and collisional force distribution were examined for the aluminum of JIS-5050 under the conditions of a spray distance of 150 mm and an aluminum erosion time of 900 seconds (Example 1), a spray distance of 130 mm and an aluminum erosion time of 900 seconds (Example 2), and a spray distance of 100 mm and an aluminum erosion time of 600 seconds (Example 3).

Comparative Examples 1 to 3

Figure 8:
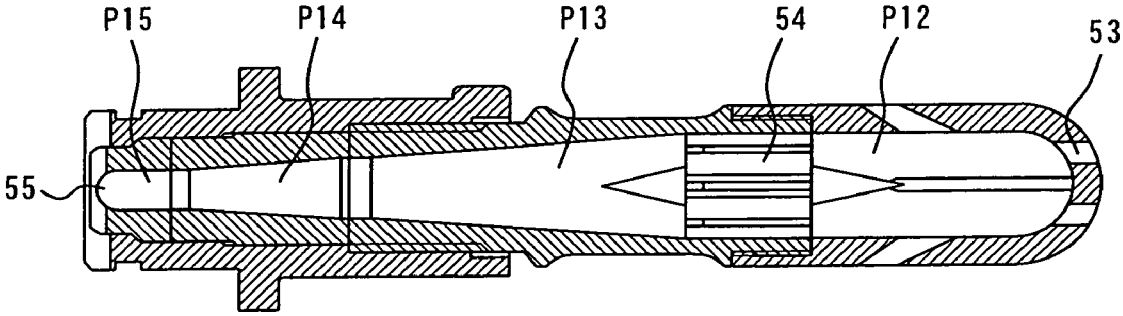
FIG. 8 is a schematic longitudinal sectional view showing the nozzle used in the Comparative Examples.

The nozzle shown in FIG. 8 was used. This nozzle had a discharge orifice (having an elliptical shape with a major diameter of 3.78 mm, a minor diameter of 2.31 mm and the ratio of major diameter/minor diameter=1.6) 55 opened at a concave surface of a groove having a U-letter configuration in cross section in the nozzle tip; a flow path (length: 10 mm) P15 with an inner diameter of $\phi$5 mm extending towards the upstream direction from the discharge orifice; an inclined flow path (length: 22 mm) P14 extending gradually at a predetermined taper angle towards the upstream direction from the upstream end of the flow path and having an inner diameter of $\phi$7.6 mm at the upstream end; a constricted flow path (length: 54 mm) P13 extending gradually with a taper angle $\theta$=7.5° towards the upstream direction from the upstream end of the inclined flow path and having an inner diameter of $\phi$13 mm at the upstream end; and a cylindrical flow path P12 having the same inner diameter as the upstream end of the constricted flow path, having a stabilizer 54 of the same type as the Examples fitted therein, and being continuous with an inflow entrance 53 at an upstream end.

The aluminum erosion amount (the converted amount in 30 seconds) and the collisional force distribution were examined using the above-described nozzles in the same manner as the Examples.

Figure 9:
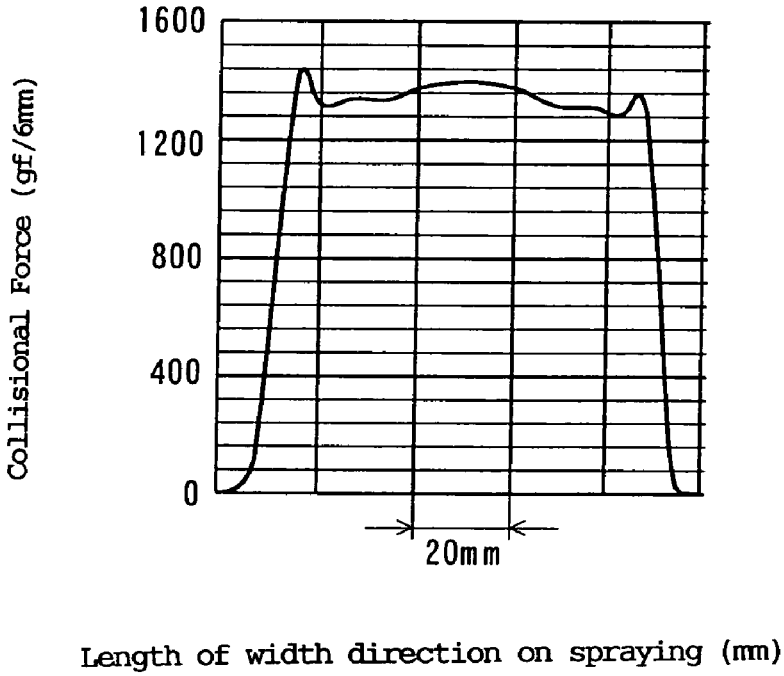
FIG. 9 is a graph showing the collisional force distribution in the width direction of the discharge flow of Example 3.
Figure 10:
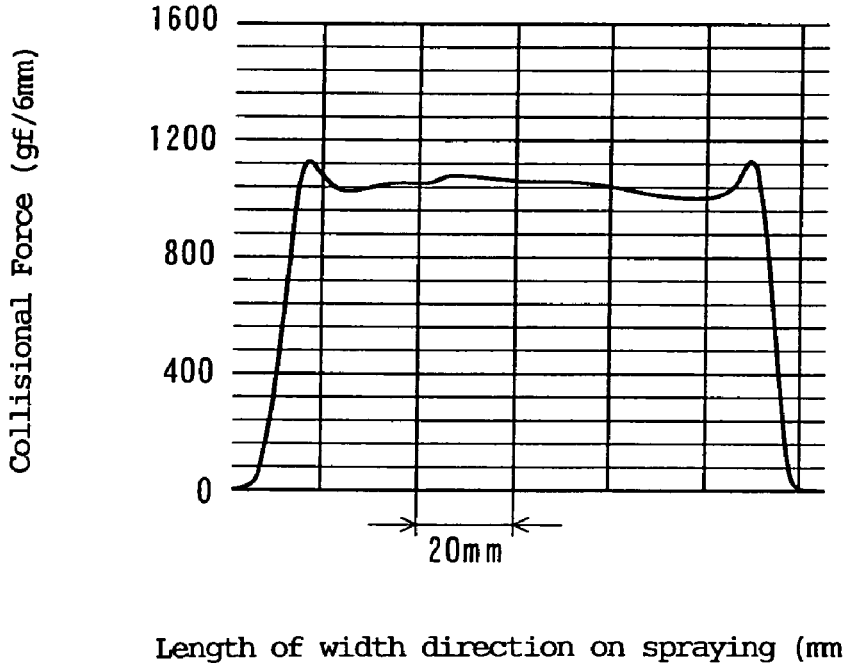
FIG. 10 is a graph showing the collisional force distribution in the width direction of the discharge flow of Example 2.
Figure 11:
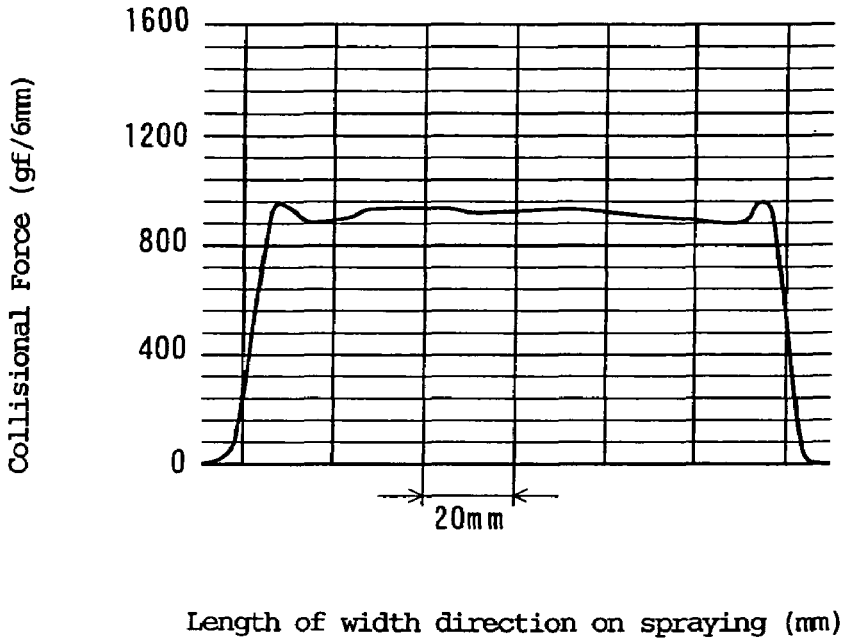
FIG. 11 is a graph showing the collisional force distribution in the width direction of the discharge flow of Example 1.
Figure 12:
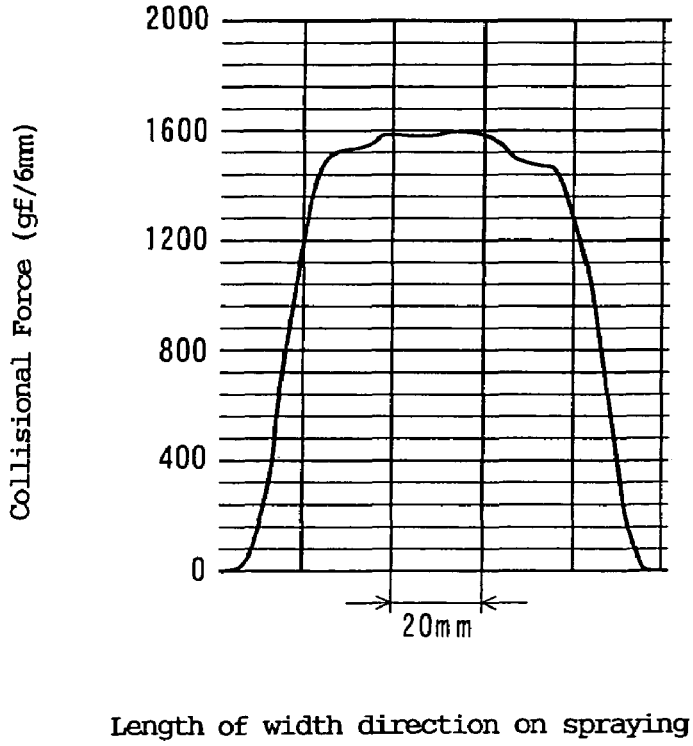
FIG. 12 is a graph showing the collisional force distribution in the width direction of the discharge flow of Comparative Example 3.
Figure 13:
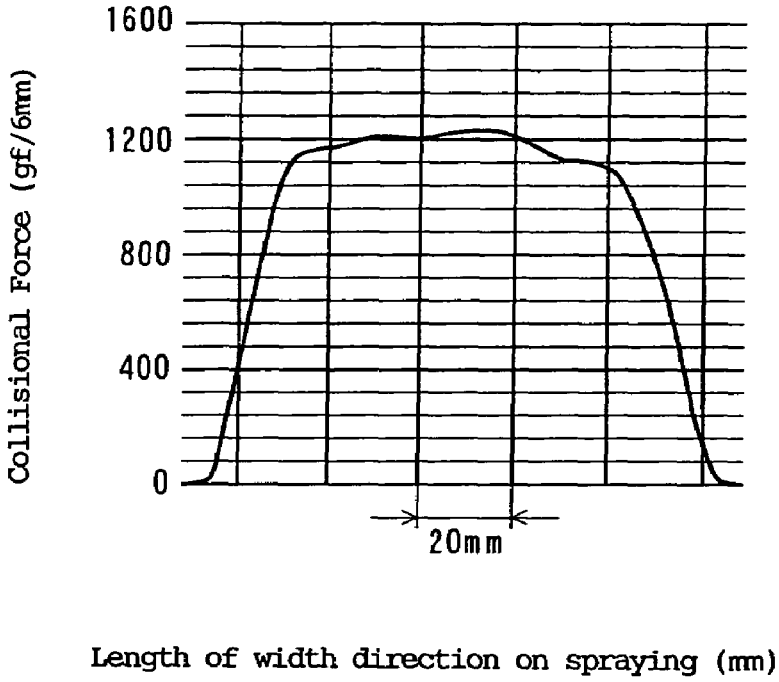
FIG. 13 is a graph showing the collisional force distribution in the width direction of the discharge flow of Comparative Example 2.
Figure 14:
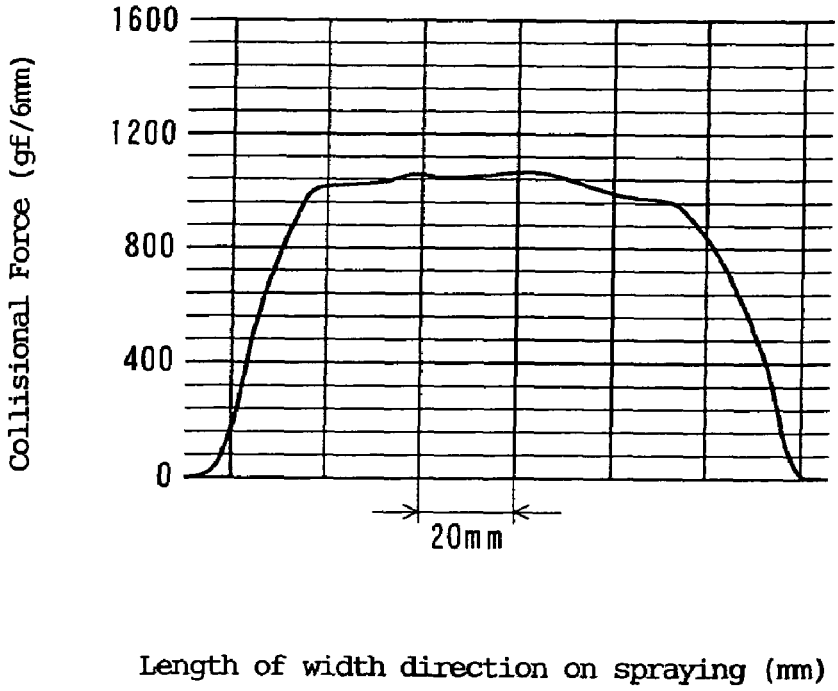
FIG. 14 is a graph showing the collisional force distribution in the width direction of the discharge flow of Comparative Example 1.

The results are shown in Table 1, the collisional force distributions in the width direction of the discharge flow for Examples 1 to 3 are shown in FIGS. 9 to 11, and the collisional force distributions in the width direction of the discharge flow for Comparative Examples 1 to 3 are shown in FIGS. 12 to 14.

TABLE 1

| | Spray distance and erosion time | Al erosion amount (30 seconds) | Collisional force distribution | |
|---|---|---|---|---|
| | | | Raise at both side parts | Uniformitiy in the width direction |
| Example 1 | 150 mm × 900 seconds | 0.013 g | Sharp | Both side parts are high and substantially uniform |
| Example 2 | 130 mm × 900 seconds | 0.024 g | Sharp | Both side parts are high and substantially uniform |
| Example 3 | 100 mm × 600 seconds | 0.029 g | Sharp | Both side parts are high and substantially uniform |
| Comparative Example 1 | 150 mm × 900 seconds | 0.002 g | Gradual | Hill-like distribution |
| Comparative Example 2 | 130 mm × 900 seconds | 0.010 g | Gradual | Hill-like distribution |
| Comparative Example 3 | 100 mm × 600 seconds | 0.021 g | Gradual | Hill-like distribution |

As is clear from the Table and the drawings, high descaling properties are obtained by the Examples in comparison to the Comparative Examples.

Comparative Example 4

Examining the aluminum (Al) erosion amount (the converted amount in 30 seconds) in the same manner as in Example 1 except for using the following spray nozzle instead of the spray nozzle of Example 1, the aluminum (Al) erosion amount was 0.004 g. This spray nozzle had a discharge orifice (having an elliptical shape with a major diameter of 3.78 mm, a minor diameter of 2.31 mm, and the ratio of major diameter/minor diameter=1.6) opened at a concave surface of a groove having a U-letter configuration in cross section in the nozzle tip; an inclined flow path extending at a taper angle of 50° towards the upstream direction from the discharge orifice and having an inner diameter of ϕ6 mm at the upstream end; an inclined flow path (length: 11 mm) extending gradually with a taper angle of about 5° towards the upstream direction from the upstream end of the inclined flow path and having an inner diameter of ϕ11 mm at the upstream end; a constricted flow path (length: 54 mm) extending gradually with a taper angle θ=7.5° towards the upstream direction from the upstream end of the inclined flow path and having an inner diameter of ϕ13 mm at the upstream end; and a cylindrical flow path having the same inner diameter as the upstream end of the constricted flow path, having a stabilizer of the same type as the Examples fitted therein, and being continuous with an inflow entrance at an upstream end.

Comparative Example 5

Examining the aluminum (Al) erosion amount (the converted amount in 30 seconds) in the same manner as in Example 1 except for using the following spray nozzle (corresponding to a spray nozzle described in DE No. 92U17671 Specification) instead of the spray nozzle of Example 1, the aluminum (Al) erosion amount was 0.007 g. This spray nozzle had a discharge orifice (having an elliptical shape with a major diameter of 3.78 mm, a minor diameter of 2.31 mm, and the ratio of major diameter/minor diameter=1.6) opened at a concave surface of a groove having a U-letter configuration in cross section in a nozzle tip; a first inclined flow path extending at a taper angle of 50° towards the upstream direction from the discharge orifice and having an inner diameter of ϕ6 mm at the upstream end; a cylindrical flow path (length: 9 mm) extending at an inner diameter of ϕ6 mm towards the upstream direction from the upstream end of the inclined flow path; the second inclined flow path extending at a taper angle of 80° towards the upstream direction from the upstream end of the cylindrical flow path; a cylindrical flow path (length: 43 mm) with an inner diameter of ϕ11 mm extending towards the upstream direction from the upstream end of the second inclined flow path; a constricted flow path (length: 54 mm) extending gradually with a taper angle θ=7.5° towards the upstream direction from the upstream end of the cylindrical flow path and having an inner diameter of ϕ13 mm at the upstream end; and a cylindrical flow path having the same inner diameter as the upstream end of the constricted flow path, having a stabilizer of the same type as the Examples fitted therein, and being continuous with an inflow entrance at an upstream end.

The invention claimed is:

1. A descaling nozzle for removing scale from a steel plate surface by discharging water from a nozzle, wherein the nozzle has a nozzle orifice comprising:

a discharge orifice opening at a concave surface or concave area of a front end, wherein the discharge orifice opening has a minor diameter $D_2$;

a tapered segment extending towards the upstream side from said discharge orifice with a taper angle θ of 30 to 80°; and a large-diameter segment continuing with said tapered segment, said large-diameter segment having an inner diameter $D_1$; and the ratio ($D_1/D_2$) of the inner diameter $D_1$ of the large-diameter segment relative to the minor diameter $D_2$ of said discharge orifice is not less than 3, wherein the discharge flow from the nozzle spreads in a single direction (width direction) within a plane perpendicular to the central axis of the nozzle, and the nozzle has an erosion thickness angle of 1.5 to 3° in the direction (thickness direction) that is perpendicular to the width direction, when said erosion thickness angle is determined for an aluminum of JIS-5050 under the conditions of a letting pressure of a spray of 15 MPa, a spray distance of 150 mm and an aluminum erosion time of 900 seconds.

2. A descaling nozzle according to claim 1, wherein the discharge orifice has an elliptical shape and the large-diameter segment defines a cylindrical passage, and the ratio ($D_1/D_2$) of the inner diameter $D_1$ of the large-diameter segment relative to the minor diameter $D_2$ of said discharge orifice is 3 to 6.

3. A descaling nozzle according to claim 1, which removes scale from a steel plate surface by discharging water from the nozzle at a pressure of 5 to 30 MPa and a discharge flow rate of 40 to 200 l/minute, wherein the taper angle θ of the conical tapered segment is 40 to 70° and the ratio ($D_1/D_2$) of the inner diameter $D_1$ of the large-diameter segment relative to the minor diameter $D_2$ of said discharge orifice is 4 to 6.

4. A descaling nozzle according to claim 1, wherein the flow path of the nozzle comprises the discharge orifice opening in an elliptical configuration at the concave surface or concave area at the front end, the tapered flow path extending towards the upstream side from the discharge orifice with spreading at a taper angle θ of 40 to 60°, and the cylindrical flow path extending from the upstream end of the tapered flow path with the inner diameter being substantially the same.

5. A descaling nozzle according to claim 4, wherein in the elliptical discharge orifice, the ratio of the major diameter relative to the minor diameter is 1.2 to 2.5, and the ratio ($D_1/D_2$) of the inner diameter $D_1$ of the conical flow path relative to the minor diameter $D_2$ of the discharge orifice is 4 to 6.

6. A descaling nozzle according to claim 1, which has a nozzle tip fitted to a front end, wherein the nozzle tip comprises a concave surface or concave area formed at a front end, a discharge orifice opening at the concave surface or concave area, and a conical flow path spreading at a predetermined taper angle θ towards the upstream side from the discharge orifice, and the concave surface or concave area comprises an inclined side wall which inclines inwardly in the radial direction towards the upstream side from the front end.

7. A descaling nozzle according to claim 1, wherein a front end of the nozzle includes a carbide nozzle tip formed of cemented carbide.

8. A descaling nozzle for removing scale from a steel plate surface by discharging water from a nozzle, wherein the nozzle is provided with a nozzle orifice comprising a discharge orifice opening at a concave surface or concave area of a front end, a tapered segment extending from said discharge orifice, and a large-diameter segment continuing with said tapered segment, wherein a ratio ($D_1/D_2$) of an inner diameter $D_1$ of the large-diameter segment relative to a minor diameter $D_2$ of said discharge orifice is not less than 3 and less than 7, wherein the discharge flow from the nozzle spreads in a single direction (width direction) within a plane perpendicular to the central axis of the nozzle, and the nozzle has an erosion thickness angle of 1.5 to 3° in the direction (thickness direction) that is perpendicular to the width direction, when said erosion thickness angle is determined for an aluminum of JIS-5050 under the conditions of a letting pressure of a spray of 15 MPa, a spray distance of 150 mm and an aluminum erosion time of 900 seconds.

9. A descaling nozzle according to claim 8, wherein the taper angle θ of the tapered segment is 30 to 80°.

10. A descaling nozzle according to claim 8, wherein the discharge orifice has an elliptical shape and the ratio ($D_1/D_2$) of the inner diameter $D_1$ of the large-diameter segment relative to the minor diameter $D_2$ of said discharge orifice is 3 to 6.

11. A descaling nozzle according to claim 8, wherein the flow path of the nozzle comprises the discharge orifice opening in an elliptical configuration at the concave surface or concave area at the front end, the tapered flow path extending towards the upstream side from the discharge orifice with spreading at a taper angle θ of 40 to 60°, and the cylindrical flow path extending from the upstream end of the tapered flow path with the inner diameter being substantially the same.

12. A descaling nozzle according to claim 8, which has a nozzle tip fitted to a front end, wherein the nozzle tip comprises a concave surface or concave area formed at a front end, a discharge orifice opening at the concave surface or concave area, and a conical flow path spreading at a predetermined taper angle θ towards the upstream side from the discharge orifice, and the concave surface or concave area comprises an inclined side wall which inclines inwardly in the radial direction towards the upstream side from the front end.

13. A descaling nozzle according to claim 12, wherein the nozzle tip is a carbide nozzle tip formed out of cemented carbide.

* * * * *

UNITED STATES PATENT AND TRADEMARK OFFICE

CERTIFICATE OF CORRECTION

PATENT NO. : 7,367,518 B2
APPLICATION NO. : 10/505478
DATED : May 6, 2008
INVENTOR(S) : Akihiko Tanigaki et al.

It is certified that error appears in the above-identified patent and that said Letters Patent is hereby corrected as shown below:

In column 16, claim 1, line 60, please change “letting” to --jetting--.

In column 18, claim 8, line 12, please change “letting” to --jetting--.

Signed and Sealed this

Sixteenth Day of September, 2008

JON W. DUDAS
*Director of the United States Patent and Trademark Office*